United States Patent [19]

Sugawara

[11] Patent Number: 4,799,032

[45] Date of Patent: Jan. 17, 1989

[54] DIRECTIONAL COUPLER

[75] Inventor: Hideo Sugawara, Otawara, Japan

[73] Assignee: Fujitsu Limited, Kawasaki, Japan

[21] Appl. No.: 84,190

[22] Filed: Aug. 12, 1987

[30] Foreign Application Priority Data

Aug. 12, 1986 [JP] Japan ..... 61-189083

[51] Int. Cl.[4] ..... H01P 3/08

[52] U.S. Cl. ..... 333/116; 333/246

[58] Field of Search ..... 333/116, 117, 109, 246

[56] References Cited

U.S. PATENT DOCUMENTS 4,288,760 9/1981 Beyer et al. ..... 333/116

4,701,724 10/1987 Martin ..... 333/109 X

FOREIGN PATENT DOCUMENTS 0006058 1/1977 Japan ..... 333/116

61-116404 6/1986 Japan .

*Primary Examiner*—Eugene R. LaRoche

*Assistant Examiner*—Seung Ham

*Attorney, Agent, or Firm*—Staas & Halsey

[57] ABSTRACT

A directional coupler includes a main line (1) and two conductive pads (2*a*, 3*a*) which are capacitively coupled to the main line (1) in a lumped constant fashion. The conductive chips (2*a*, 3*a*) are separated by a distance of λg/4. Signals on the conductive pads (2*a*, 3*a*) are transferred, through first and second conductive patterns (B1, B2) narrower than the main line, to an output terminal. The first conductive pattern and the second conductive pattern are different in length by 80 g/4, and a loose and directional coupling signal is obtained at the output terminal.

9 Claims, 6 Drawing Sheets

DIRECTIONAL COUPLER

BACKGROUND OF THE INVENTION

1. Field of the Invention

The present invention relates to an improved directional coupler which is used in the microwave band field, and more particularly, to a loosely coupled type directional coupler constructed by microstrip lines and utilized, for example, as an output monitor of a high power microwave amplifier.

This kind of directional coupler should have a coupling of lower than −20 dB and a satisfactory directivity.

2. Description of the Related Art

Conventional directional couplers are classified into two types, i.e., a branch line coupling type and a distributed coupling type.

The branch line coupling type has a disadvantage in that, when the coupling must be made very small, in order to monitor the output power with a small power loss in the main line, the line width of the microstrip line used as a coupling arm becomes very narrow and is difficult to manufacture.

The distributed coupling type has a disadvantage in that this type of directional coupler has almost no directivity when the coupling is very small.

SUMMARY OF THE INVENTION

An object of the present invention is to provide a loose coupling type directional coupler.

Another object of the present invention is to provide a directional coupler having a lumped constant coupling.

Still another object of the present invention is to provide a directional coupler by which the output of a high power microwave amplifier can be monitored.

To attain the above objects there is provided, according to the present invention, a directional coupler comprising a main line, a first series circuit, a second series circuit, a first conductive pattern, a second conductive pattern, and an output terminal. The main line is formed by a microstrip line. The first series circuit includes a first conductive pad and a first resistor connected in series. The first resistor has one end connected to the ground. The second series circuit includes a second conductive pad and a second resistor connected in series. The second resistor has one end connected to the ground. The first conductive pad and the second conductive pad are placed adjacent to the main line to realize a desired loose coupling between the main line and the first or second conductive pad. The first conductive pad and the second conductive pad are separated by a distance equal to λg/4, where λg is the wavelength of the signal supplied to the main line. The first conductive pattern has one end connected to the first conductive pad and has a width narrower than the width of the main line. The second conductive pattern has one end connected to the second conductive pad and has a width narrower than the width of the main line. The first conductive pattern has a length different by λg/4 from the length of the second conductive pattern. The output terminal is connected to another end of the first and second conductive patterns.

BRIEF DESCRIPTION OF THE DRAWINGS

The above objects and features of the present invention will be more apparent from the following description of the embodiments of the present invention with reference to the accompanying drawings, wherein.

DESCRIPTION OF THE PREFERRED EMBODIMENTS

For a better understanding of the present invention, conventional directional couplers will first be described with reference to FIGS. 4A and 4B. Conventionally, as directional couplers constructed by microstrip lines, two types of directional couplers are known as shown in FIGS. 4A and 4B.

Figure 4A:
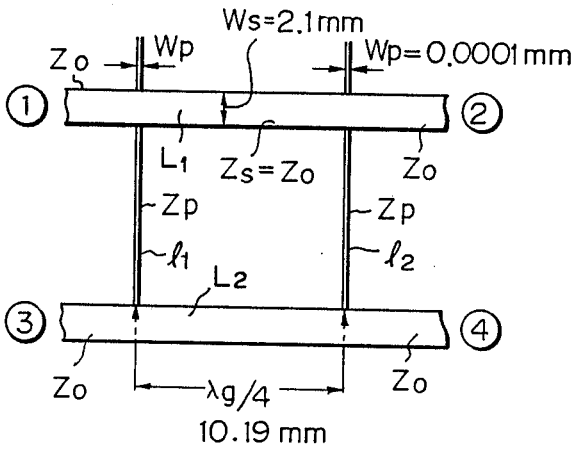
Fig. 4A PRIOR ART
FIG. 4A is a pattern arrangement of a conventional branch line coupling type directional coupler.
Figure 4B:
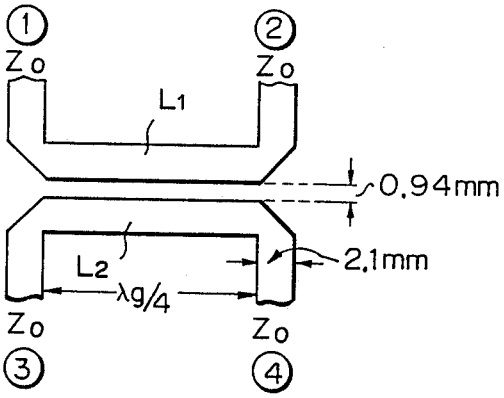
Fig. 4B PRIOR ART
FIG. 4B is a pattern arrangement of a conventional distributed coupling type directional coupler.

FIG. 4A shows one of the conventional directional coupler in which strip lines on a dielectric substrate are formed as a branch line hybrid type, or in another words, a branch line coupling type. The directional coupler in FIG. 4A consists of two signal passing arms $L_1$ and $L_2$ arranged in parallel to each other and each having a characteristic impedance $Z_S$, and two coupling arms $l_1$ and $l_2$ arranged in parallel to each other and extending perpendicular to the signal passing arms $L_1$ and $L_2$. The coupling arms $l_1$ and $l_2$ are separated by about λg/4, where λg is the wavelength of the input signal. The characteristic impedance of each of the coupling arms is $Z_P$. The signal passing arm $L_1$ has an input line ① a characteristic impedance of $Z_0$ and an output line ② the same characteristic impedance of $Z_0$. The signal passing arm $L_2$ has an input line ③ and an output line ④.

An input signal supplied to the input line ① with the characteristic impedance $Z_0$ is output from output lines ② and ④.

The coupling between the input line and the output line ④ is determined by the characteristic impedance $Z_S$, is equal to $Z_0$ in the figure, of the signal passing line $L_1$ or $L_2$, and the characteristic impedance $Z_P$ of the coupling arm $l_1$ or $l_2$. The characteristic impedances $Z_P$ and $Z_S$ are determined by the line width $W_S$ of the conductive line $L_1$ or $L_2$, the line width $W_P$ of the conductive line $l_1$ or $l_2$, and the dielectric constant, that is, the permittivity, of a dielectric substrate on which the lines $L_1$, $L_2$, $l_1$, and $l_2$ are formed.

FIG. 4B shows another conventional directional coupler, which is referred to as a quadrature hybrid type coupler, or in other words, a backward wave coupler or a distributed coupling type directional coupler. The directional coupler shown in FIG. 4B consists of two microstrip lines $L_1$ and $L_2$ arranged in parallel to each other. The length of each of the microstrip lines $L_1$ and $L_2$ is about $\lambda g/4$. The necessary coupling is obtained by the distributed coupling between the edges of the microstrip lines $L_1$ and $L_2$.

The directional coupler shown in FIG. 4B is analyzed by the even/odd orthogonal mode excitation method. If a desired coupling and a load impedance $Z_0$ are given for the directional coupler to be designed, the two orthogonal mode impedances $Z_{0e}$ and $Z_{00}$ can be calculated. When the orthogonal mode impedances $Z_{0e}$ and $Z_{00}$ are determined, the practical physical size of the microstrip lines can be obtained by the use of the characteristic impedances of the coupling lines to be used. (See, for example, "Microwave Circuit for Communication", issued by the Electronic Communication Conference, Japan p. 54.)

In the above-described prior art, the design of a directional coupler is theoretically possible.

The branch line coupling type shown in FIG. 4A, however, cannot be practically realized because the line width $W_P$ of the microstrip line $l_1$ or $l_2$ becomes too narrow to be formed. For example, assuming that the branch line coupling type directional coupler shown in FIG. 4A is a loose coupling type with a coupling lower than −20 dB, that the directional coupler is formed on a Teflon glass (registered trade mark) substrate with a thickness of 0.8 mm and with a specific permittivity $\epsilon_r=2.6$, that the main frequency is 5 GHz, and that impedance $Z_0$ or $Z_S$ is 50 Ω, then the width $W_P$ of the microstrip line $l_1$ or $l_2$ becomes narrower than 0.1 micron, which cannot be manufactured under present microstrip line manufacturing technology.

The distributed coupling type directional coupler shown in FIG. 4B also has a problem in that it has almost no directivity, because the phase velocities of the two orthogonal modes, i.e., the even mode and the odd mode, of the transmitting signals are different. The noncoincidence of the phase velocities occurs because of the nonuniformity of the transmitting medium. That is, air lies above the microstrip line but a dielectric is under the microstrip line. In general, the phase velocity $\theta_e$ of the even mode is smaller than the phase velocity $\theta_0$ of the odd mode. The difference of the phase velocities causes a coupling of about −23 dB from the input line ① to the input line ④ when the specific permittivity $\epsilon_r$ is 9.6. As an ideal directional coupler, the coupling between the terminals ① and ③ is −10 dB, and the coupling between the terminals ① and ④ should be zero. In practice, however, a coupling of about −23 dB appears between the terminals ① and ④. Therefore, as mentioned before, the conventional distributed coupling type has almost no directivity when the coupling is very small.

Figure 1:
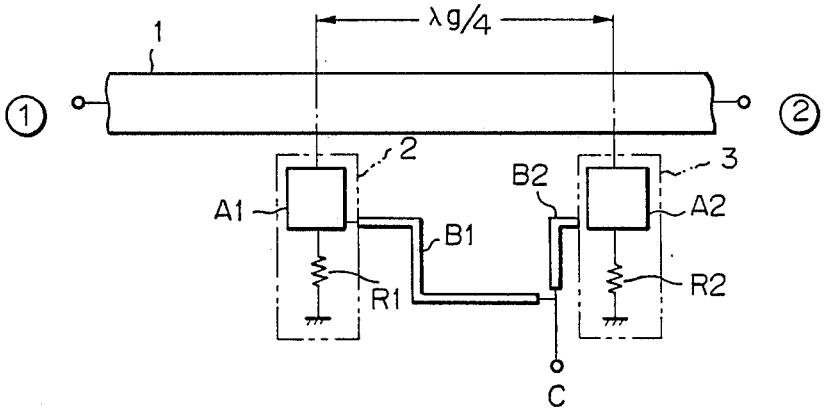
FIG. 1 shows a principle of a pattern arrangement diagram of a directional coupler according to the present invention.

The principle of the present invention is illustrated trated in FIG. 1, wherein metal patterns (or, in other words, conductive pads) A1 and A2 are placed to be adjacent to a main line 1 formed by a microstrip line. A part of the power passing through the main line 1 is transferred to the metal patterns A1 and A2, which are electromagnetically or capacitively coupled to the main line 1 in a lumped constant fashion. The metal patterns A1 and A2 are separated by a distance equal to $\lambda g/4$, where $\lambda g$ is the wavelength of the signal supplied to the main line 1. Because of the separation between the metal patterns A1 and A2, signals on the metal patterns A1 and A2 have a phase difference of about 90 degrees from each other. By conducting the signals on the metal patterns A1 and A2 through narrow-width patterns B1 and B2 having an appropriate length to an output terminal C, a loose coupling and a sufficient directivity can be obtained in the directional coupler, as long as the narrow-width patterns B1 and B2 are so narrow in width that they are hardly coupled to the main line.

Since the pattern B1 is made longer than the pattern B2 by $\lambda g/4$, a part of the power transmitting from the input line ① to the output line ② is separated, on one hand, to be transferred through the patterns A1 and B1 to the output terminal C, and on the other hand, to be transferred through the patterns A2 and B2 to the output terminal C. In this case, the phase of the signal through the pattern B1 and the phase of the signal through the pattern B2 are the same at the output terminal C.

If the power is transmitted from the line ② to the line ①, the phase of the signal at the terminal C through the pattern B1 is opposite to the phase of the signal at the output terminal C through the pattern B2. Therefore, the power at the output terminal C is zero.

Accordingly, a part of the signal transmission from the line ① the line ② appears at the output terminal C, whereas the signal transmission from the line ② to the line ① not appear at the output terminal C. Thus, a directional coupler is realized.

Figure 2A:
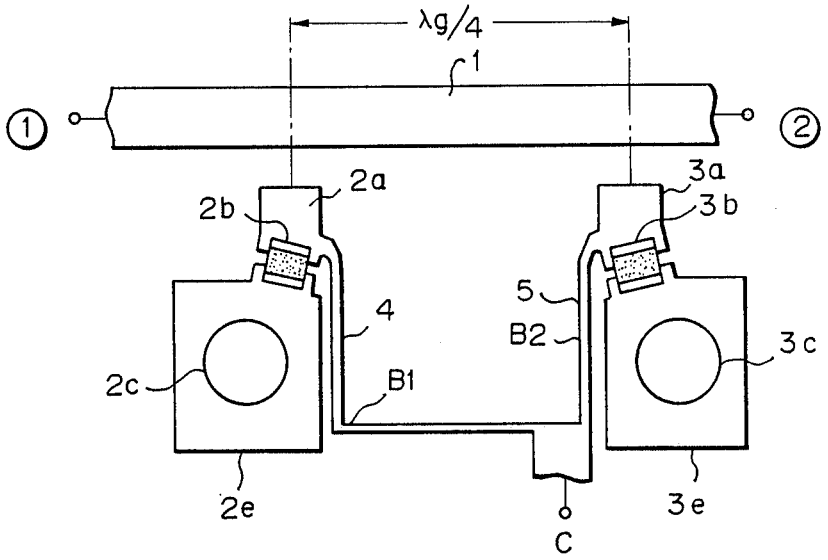
FIG. 2A is a pattern arrangement diagram of a directional coupler according to the first embodiment of the present invention.

FIG. 2A is a pattern arrangement diagram of a directional coupler according to the first embodiment of the present invention.

The directional coupler shown in FIG. 2A is a power monitor with a central frequency of about 6 GHz. The power monitor shown in FIG. 2A outputs, at the output terminal C, a power of 1/300th of the power supplied from the input line ① of the main line ① The coupling is about −25 dB.

If the power is input from the line ②, a signal is not output from the terminal C.

Figure 2B:
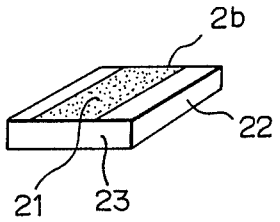
FIG. 2B is a perspective view of the resistor shown in the diagram of FIG. 2A.

The directional coupler shown in FIG. 2A is formed on a Teflon glass substrate with a thickness of 0.8 mm. FIG. 2A shows upper conductors of microstrip lines formed on the substrate, wherein 1 is a main line with a width of about 2.2 mm, 2*a* and 3*a* are coupling metal patterns or conductive pads separated from each other by about 8.6 mm, and 2*b* and 3*b* are terminating resistors. Each of these resistors 2*b* and 3*b* in this embodiment is a chip resistor having a resistance film 21 and conductive films 22 and 23, as shown in FIG. 2B. These resistors act to stabilize the circuit. A resistance value of resistors is 100 Ω in this embodiment.

Numerals 4 and 5 denote the conductive patterns B1 and B2 which conduct the coupled signals to the output terminal C. Each of the conductive patterns has a width of about 0.55 mm in this embodiment, so that the characteristic impedance becomes 100 Ω. Therefore, the output impedance when viewed from the output terminal C is 50 Ω, which matches the input impedances of various measuring devices to be connected to the output terminal C. In this embodiment, the length of the conductive pattern 4 is about 17 mm, and the length of the conductive pattern 5 is about 8.3 mm. Numerals 2*e* and 3*e* in FIG. 2A denote grounding patterns, and 2*c* and 3*c* denote grounding through holes.

Figure 3A:
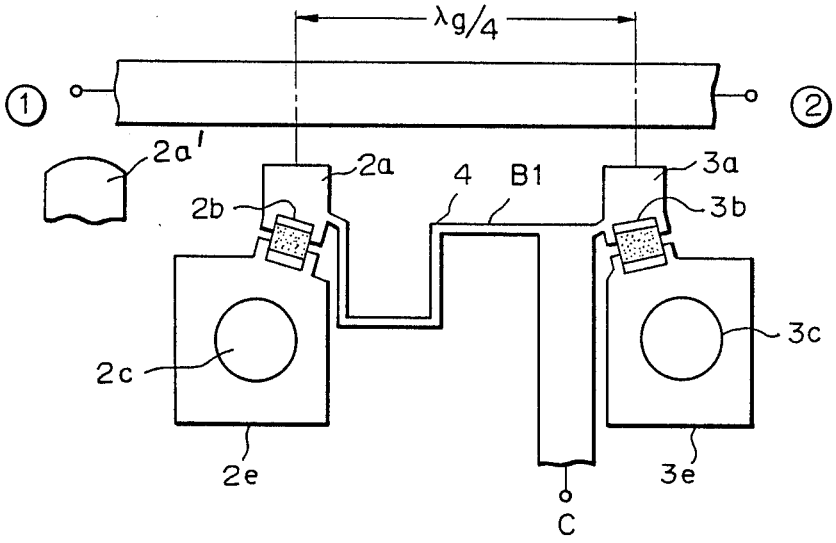
FIG. 3A is a pattern arrangement diagram of a directional coupler according to the second embodiment of the present invention.

FIG. 3A shows a second embodiment of the present invention. In the figure, the same reference numbers and symbols as in FIG. 2A are given to the same parts and functions. In the second embodiment shown in FIG. 3A, the conductive pattern B2 in FIG. 2A is eliminated. In other words, the length of the conductive pattern B2 is substantially zero. Therefore, the coupled waves at the conductive patterns 2*a* and 3*a* are added at the conductive pattern 3*a*. Accordingly, the conductive pattern 5 in the first embodiment can be omitted, resulting in a small scale directional coupler.

Figure 3B:
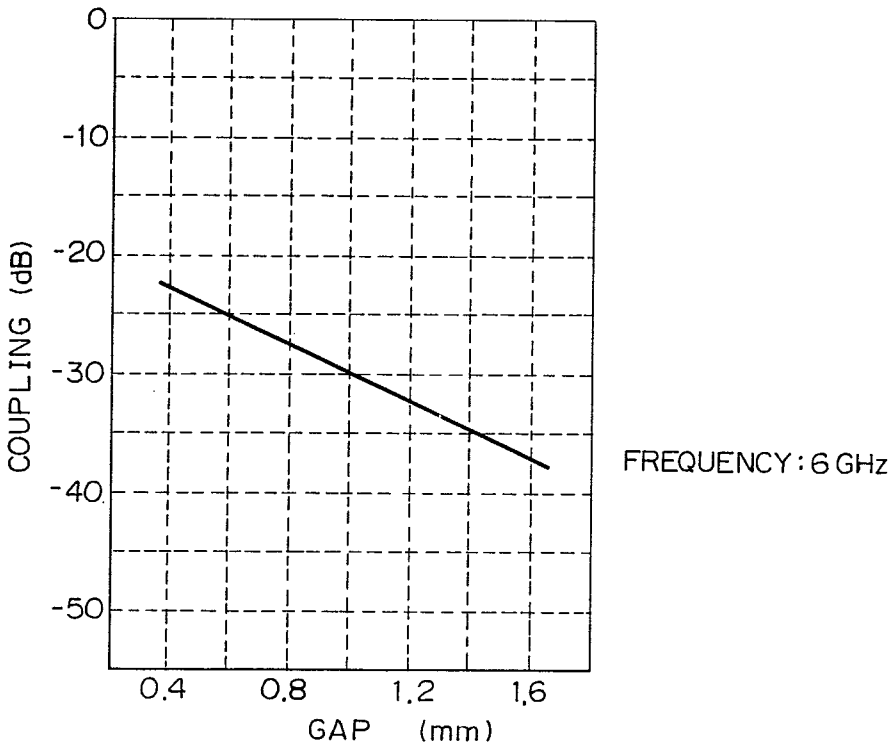
FIG. 3B is a graph showing the relationship between the gap and the coupling in the second embodiment.

FIG. 3B is a graph showing the relationship between the gap and the coupling in the second embodiment.

As shown in FIG. 3B, the coupling decreases linearly in proportion to the gap between the main line and the edge of the conductive pattern 2*a* or 3*a*.

Figure 3C:
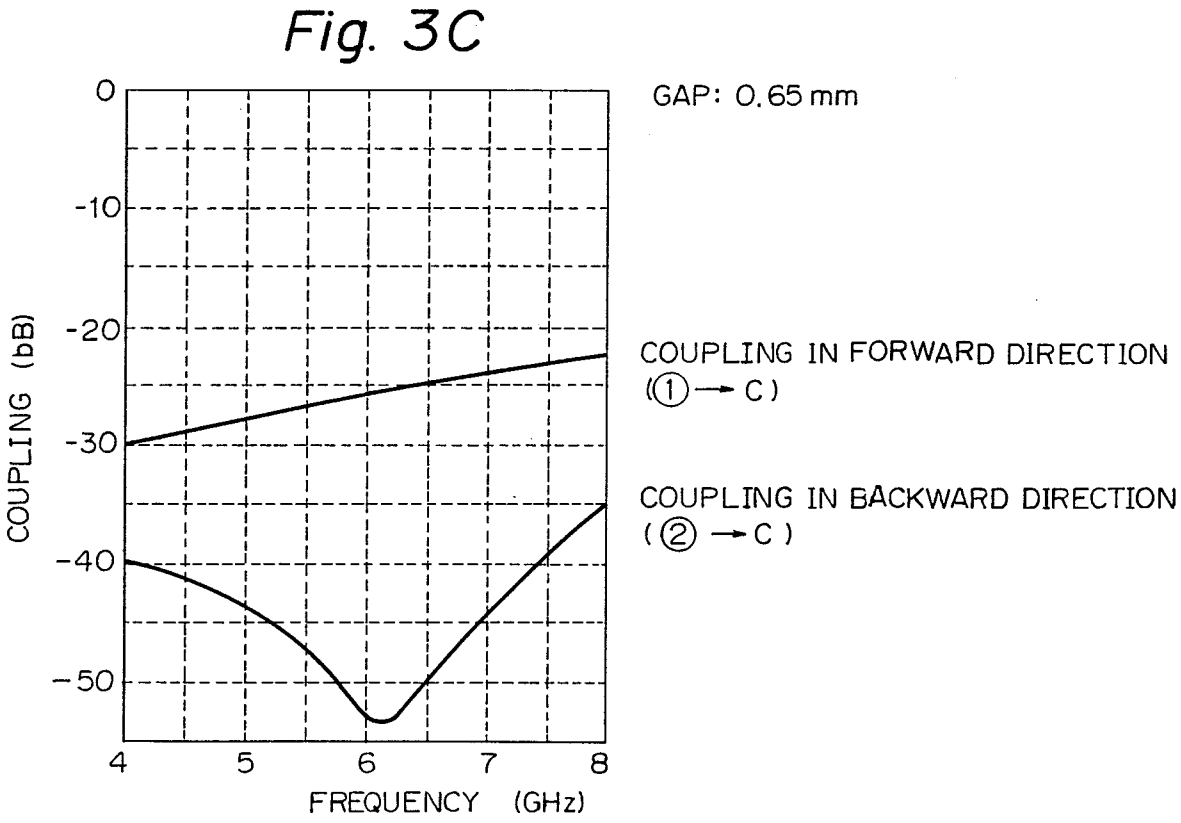
FIG. 3C is a graph showing the relationship between the frequency and the coupling.

FIG. 3C is a graph showing the relationship between the frequency and the coupling in the second embodiment.

In FIG. 3C, the gap between the main line 1 and the metal pattern 2*a* or 3*a* is made 0.65 mm. The coupling in the forward direction increases linearly in accordance with the increase of the frequency. The coupling in the reverse direction is lower than that in the forward direction. In particular, the coupling in the reverse direction is the lowest at the frequency of about 6.2 GHz. Note that the forward direction means that the input signal is supplied from the input line ① to the output line ②, whereas the reverse direction means that the input signal is supplied from the output line ② to the input line ①.

The present invention restricted to the above-described embodiments, and various changes and modifications are possible without departing from the scope of the invention. For example, the shape of the coupling metal pattern 2*a* or 3*a* is not restricted to that of a rectangle. In order to realize a desired coupling, the edge of the metal pattern 2*a* or 3*a* opposing the main line 1 may be curved as illustrated in FIG. 3A by 2*a*'.

From the foregoing description, it is apparent that, according to the present invention, a loose coupling directional coupler, which has not been easily realized conventionally, can be provided and that it can be used as a small monitoring device for monitoring power of a high performance radio equipment.

What is claimed is:

1. A directional coupler comprising:

a main line formed by a microstrip line;

a first series circuit including a first conductive pad and a first resistor connected in series, said first resistor having open end connected to the ground;

a second series circuit including a second conductive pad and a second resistor connected in series, said second resistor having one end connected to ground, said first conductive pad and said second conductive pad being placed adjacent to said main line so as to realize a desired loose coupling between said main line and said first or second conductive pads, and said first conductive pad and said second conductive pad being separated by a distance equal to λg/4, where λg is the wavelength of the signal supplied to said main line;

a first conductive pattern having a first end connected to said first conductive pad, having a second end, and having a width narrower than the width of said main line;

a second conductive pattern having a first end connected to said second conductive pad, having a second end and having a width narrower than the width of said main line, said first conductive pattern having a length different by λg/4 from the length of said second conductive pattern; and an output terminal directly connected to the second ends of said first and second conductive patterns.

2. A directional coupler as set forth in claim 1, wherein said first and second conductive pads are placed so as to be in capacitive coupling with said main line in a lumped constant fashion.

3. A directional coupler as st forth in claim 1, wherein said first and second conductive pads are placed so as to obtain a monitoring power at said output terminal.

4. A directional coupler as set forth in claim 1, wherein the resistances of said first and said second resistors are determined so as to stabilize the output signal at said output terminal.

5. A directional coupler as set forth in claim 1, wherein the length of said second conductive pattern is substantially equal to zero.

6. A directional coupler comprising:

a microstrip line for carrying a signal;

first and second conductive pads being placed adjacent to said microstrip line so as to realize a desired loose coupling between said microstrip line and said first or second conductive pads, said first and second conductive pads being separated by a distance equal to λg/4, where λg is the wavelength of the signal carried by said microstrip line;

a first conductive pattern having a first end connected to said first conductive pad, having a second end, and having a width narrower than the width of said microstrip line;

a second conductive pattern having a first end connected to said second conductive pad, having a second end, and having a width narrower than the width of said microstrip line, said first conductive pattern having a length different by λg/4 from the length of said second conductive pattern; and an output terminal directly connected to the second ends of said first and second conductive patterns.

7. A directional coupler as set forth in claim 6, wherein said first and second conductive pads are positioned so as to be capacitively coupled to said microstrip line in a lumped constant fashion

8. A directional coupler as set forth in claim 6, wherein said first and second conductive pads are placed so a as to obtain a monitoring power at said output terminal.

9. A directional coupler as set forth in claim 6, wherein the length of said second conductive pattern is substantially equal to zero.

* * * * *

UNITED STATES PATENT AND TRADEMARK OFFICE

CERTIFICATE OF CORRECTION

PATENT NO. : 4,799,032

DATED : JANUARY 17, 1989

INVENTOR(S) : HIDEO SUGAWARA

It is certified that error appears in the above-identified patent and that said Letters Patent is hereby corrected as shown below:

FRONT PAGE [57] ABSTRACT, line 9, delete "80";
line 10, "g/4," should be --λg/4,--.

Col. 2, line 33, "another" should be --other--;

line 52, "line and" should be --line 1 and--.

Col. 3, line 49, " 4. " should be -- 4 .--.

Signed and Sealed this

Twentieth Day of June, 1989

*Attest:*

DONALD J. QUIGG

*Attesting Officer*

*Commissioner of Patents and Trademarks*